United States Patent [19]

Krüger et al.

[11] 4,354,826

[45] Oct. 19, 1982

[54] PROCESS OF DRYING AND CALCINING BULK MATERIALS

[75] Inventors: Gerhard Krüger, Frankfurt am Main, Fed. Rep. of Germany; Werner Kepplinger, Linz, Austria

[73] Assignee: Metallgesellschaft Aktiengesellschaft, Frankfurt am Main, Fed. Rep. of Germany

[21] Appl. No.: 212,285

[22] Filed: Dec. 3, 1980

[30] Foreign Application Priority Data

Dec. 8, 1979 [DE] Fed. Rep. of Germany ..... 2949479

[51] Int. Cl.[3] ..... F26B 9/12; F27B 7/02; F26B 7/14

[52] U.S. Cl. ..... 432/18; 432/106; 432/107; 432/111; 432/112; 432/114; 432/118

[58] Field of Search ..... 432/18, 106, 107, 111, 432/112, 114, 118

[56] References Cited

U.S. PATENT DOCUMENTS

| | | | |
|---|---|---|---|
| 1,381,026 | 6/1921 | Snyder | 432/107 |
| 1,987,242 | 1/1935 | Madsen | 432/111 |
| 2,319,673 | 5/1943 | French | 432/107 |
| 3,678,598 | 7/1972 | Quiles | 432/107 |
| 4,285,773 | 8/1981 | Taciuk | 432/106 |

*Primary Examiner*—John J. Camby

*Attorney, Agent, or Firm*—Sprung, Horn, Kramer & Woods

[57] ABSTRACT

A process for drying and/or calcining bulk material in a rotary kiln when hot gases are passed countercurrent to the flow of bulk material thereto, and the bulk material is dried and/or calcined in the rotary kiln is disclosed. According to the invention, the bulk material is dried and/or calcined, as it passes from the feed end of the rotary kiln to the discharge end thereof, by contacting the same with hot gases and thereafter, as the bulk material passes towards the discharge end of the rotary kiln, the bulk material is heated by indirect heat exchange with such hot gases. An apparatus for carrying out such process is also disclosed. The apparatus is a rotary kiln equipped with a centrally disposed tube, disposed axially within the rotary kiln toward the bulk material discharge end of the rotary kiln whereby an annular space is defined between the outer wall of the central tube and inner wall of the rotary kiln. The apparatus is equipped with means for passing hot gases within the central tube, means for passing bulk material on the outer wall of the central tube whereby the bulk material can be heated by indirect heat exchange with hot gases within the tube.

6 Claims, 3 Drawing Figures

PROCESS OF DRYING AND CALCINING BULK MATERIALS

BACKGROUND OF THE INVENTION

1. Field of the Invention

This invention relates to a process of drying and calcining bulk materials in a rotary kiln with countercurrent hot gases, wherein drying and any precalcining are effected in direct contact with hot gases in that portion of the rotary kiln which adjoins the feed end, calcining is effected by an indirect heat exchange over the length of an inserted body disposed before the discharge end of the rotary kiln, and hot gases are fed into the inserted body and flow from the latter into the rotary kiln.

2. Discussion of Prior Art

When bulk materials are to be dried and calcined, it is often necessary to effect the drying and any precalcining slowly and/or at lower temperatures whereas high temperatures are required for calcining.

German Pat. No. 261,997 discloses a drying drum in which the hot gases and the material to be treated are moved cocurrently. In the rotary kiln, a heating tube smaller in diameter is succeeded by a heating tube larger in diameter. The material to be treated is charged into the annulus. One part of the hot gases is passed into the annulus and the other part into the heating tube. The rotary kiln is arranged as a stationary housing and the exhaust gases are fed into said housing for a utilization of their heat and flow countercurrently through the housing before they are passed into the chimney.

In that process, the hottest gases contact the coldest material to be treated and in consideration of the gas temperature the rotary kiln and the heating tube must consist of heat-resistant steel. The exhaust gas may cool the rotary kiln.

German Offenlegungsschrift No. 14 33 860 discloses a process of making gypsum wherein a rotary kiln contains a second tube and the material to be treated travels in the annulus to the closed end of the rotary kiln and then enters the inner tube and travels through the latter in the opposite direction to the outlet of the inner tube. The hot gases flow through the inner tube and then through the annulus countercurrently to and in direct contact with the material to be treated. The direct contact in the high-temperature zone may give rise to hot spots under fluctuating operating conditions. The equipment is rather complicated and the long inner tube must consist of high-grade steel.

It is known from "Ullmann", 3rd edition, 1951, volume 1, page 597, that drying and calcining can be effected in a countercurrent drum dryer which contains a central tube for a subsequent admixing of dry air and in which the central tube extends over a major part of the rotary kiln as far as to the beginning of the drying zone. The hot gases flow partly through the annular space and partly through the central tube. In that arrangement the direct contact in the annulus may also result in hot spots and the central tube and the rotary kiln must be made of high-grade steel.

It is known that aluminum fluorine hydrates which have been predried in a flow tube dryer or a disc dryer can be calcined in a fluidized bed furnace or the calcination can be effected in a directly or indirectly heated rotary kiln or in an externally heated fluidized-bed furnace. In all cases the furnace must consist of high-grade steel and hot spots may form where a direct contact is effected.

It is known from French Pat No. 927,063 to preheat in direct contact with hot gases and to heat further by an indirect heat transfer. The rotary kiln contains a body which has been inserted from the discharge end of the kiln and which receives hot gases and delivers them to the interior of the rotary kiln. The inserted body consists of an inner tube and refractory brickwork between the inner tube and the shell of the rotary kiln. Passages near the wall of the rotary kiln are provided in that refractory brickwork in a starlike array and receive the material to be treated and discharge it at the discharge end of the rotary kiln. The disadvantages of that process reside in that the passages are very small in diameter so that the material to be treated can travel only at a low velocity and the throughput rate is low too. The conditions are even worse because the passages are not circular. Material is retained at the entrance to the passages. Owing to that retention of material and the low throughput rate through the passages, the rotary kiln can be operated only with a low bed height. Because the passages are filled to a high degree, the tumbling is poor; this results in a retention of heat with a possible formation of hot spots and crusts. The heat transfer from the hot gases to the material in the passages is poor and irregular.

SUMMARY OF THE INVENTION

It is an object of the invention to provide a process and apparatus which reliably avoids hot spots in the calcining zone with a minimum expenditure and ensures a high throughput rate.

This object is accomplished according to the invention in that calcining is effected in an annulus by an indirect heat exchange on the surface of a body which is disposed within the rotary kiln and runs co-axial therewith.

The inserted body consists suitably of a central tube which is secured by connecting members to the inside surface of the rotary kiln. Lifting blades arranged in the annulus between the inserted body and the shell of the rotary kiln carry along the material from below and cause it to trickle onto the outside surface of the inserted body so that the material is moved through the annulus along a helical path to the discharge end. The annulus-defining inside surface of the shell of the rotary kiln may have a refractory lining. Lifting blades may be provided in the drying and possibly precalcining zone. The hot gases can be produced by a combustion directly in the inserted body or may be produced in a preceding combustion chamber. Protective gases or reactive gases may also be passed through the annulus.

According to a preferred embodiment, a partial stream of the exhaust gas from the rotary kiln is recycled into the inserted body. In that case the temperature of the exhaust gases can be reduced and controlled in a simple manner when there is no preceding combustion chamber. When the direct heating is to be effected at a much lower temperature, a partial stream of the exhaust gas may be fed into the first portion of the inserted body, when viewed from the feed end, or as far as to the end of the inserted body.

According to a preferred further embodiment, the inserted body, which can be in the form of a cylinder or tube, is secured to the shell of the rotary kiln by means of lifting blades, each lifting blade is connected at its trailing end with the shell of the rotary kiln and does not permit material to fall through, each lifting blade is connected to the inserted body by connecting members which cause material falling out of the lifting shovels to trickle down the outside surface of the inserted body, and the lifting blades have such a shape that the material falling from the leading edge trickles down on both sides of the inserted body in parts which are equal as far as possible. This results in a good and uniform heat transfer to the material to be treated.

According to a preferred further feature, the heat transfer from the hot gases to the bulk material during the indirect heat exchange is increased by providing the inserted body on the inside with ribs or pins.

According to a further preferred feature, the quantity of heat which is transferred by an indirect heat exchange per unit of material to be treated is controlled by a control of the degrees to which the annulus is filled. This permits a simple and effective control of the heat transfer.

BRIEF DESCRIPTION OF THE DRAWINGS

The invention will be explained more fully with reference to the drawings.

DESCRIPTION OF SPECIFIC EMBODIMENTS

Figure 1:
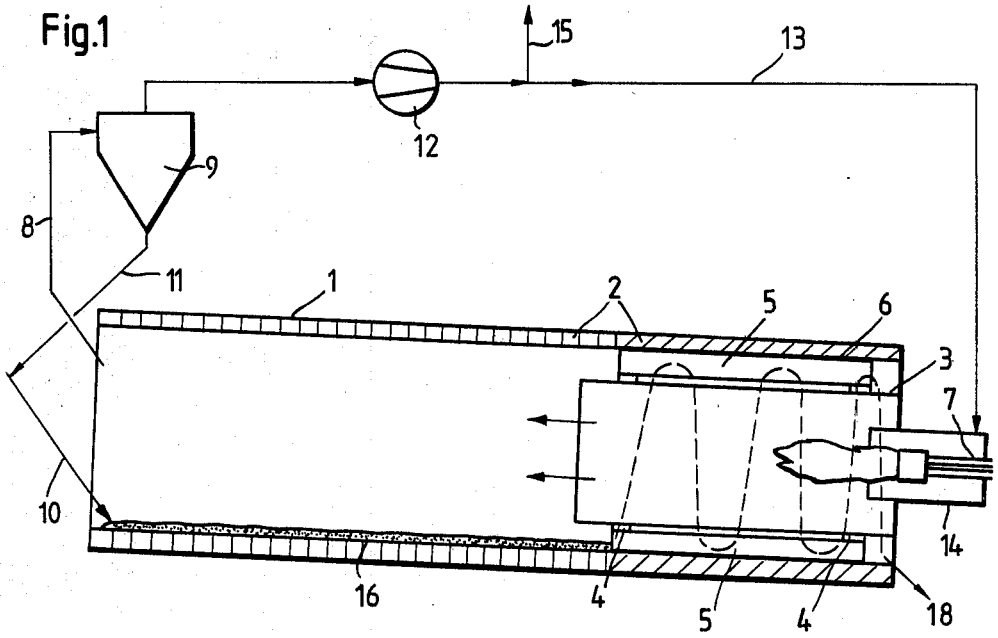
FIG. 1 is a diagrammatic longitudinal sectional view showing a rotary kiln.

The rotary kiln 1 comprises a refractory lining 2. The inserted body consists of a central tube 3. In accordance with FIGS. 1 and 2, the central tube 3 is connected by connecting members 4 and lifting blades 5 to an inner tube 6, which adjoins the refractory lining 2. The lifting blades 5 are joined at their trailing edges to the inner tube 6. In accordance with FIG. 3, the trailing edges of the lifting blades 5 are directly joined to the shell of the rotary kiln 1. A burner 7 is used to generate hot gases, which flow through the central tube 3 into the drying and possibly precalcining zone and are conducted through a conduit 8 into a cyclone separator 9. A feeder 10 is used to charge fresh material to be treated and material 11 recycled from the cyclone 9. A fan is designated 12. Part of the exhaust gas is conducted through a duct 13 and a tube 14 around the burner 7 into the central tube 3 as gas to be admixed. The remaining exhaust gas is discharged through conduit 15.

Figure 2:
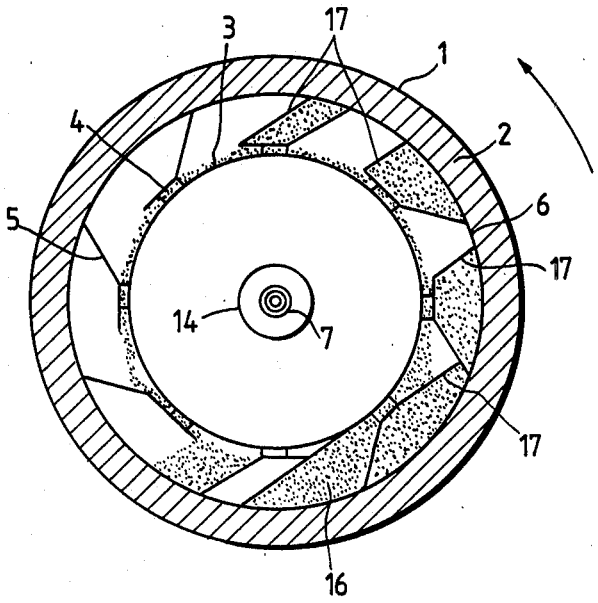
FIG. 2 is a diagrammatic transverse sectional view showing the calcining zone of the rotary kiln provided with a refractory lining.
Figure 3:
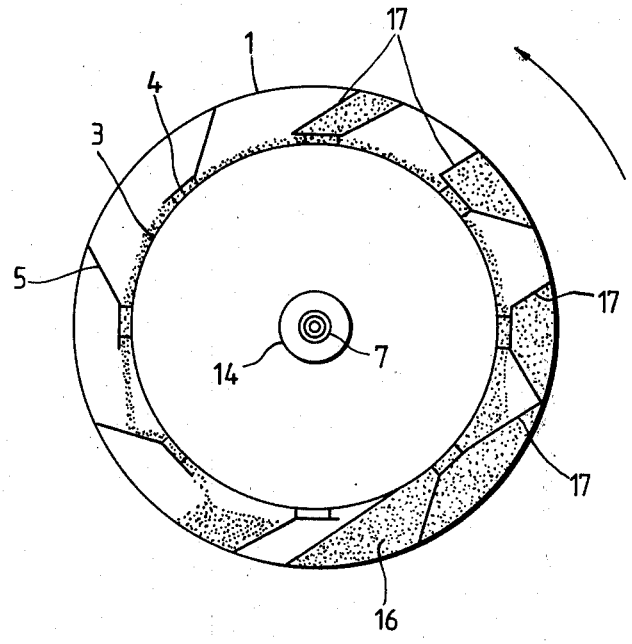
FIG. 3 is a diagrammatic transverse sectional view showing the calcining zone of a rotary kiln having no refractory lining.

Referring to FIGS. 2 and 3, the bed 16 of material to be treated travels through the drying and, if desired, precalcining zone into the calcining zone, which extends over the length of the central tube 3 and in which the material to be treated is engaged by the lifting blades 5 and forms a slope having the angle of repose of the material at the free leading edges. The angle of repose is indicated by lines 17. During the rotation of the rotary kiln 1, part of the material to be treated falls out at a controlled rate in accordance with the position of the lifting blades 5 and trickles down in a stream which is distributed over the periphery of the central tube 3. The treated material is discharged at 18 and can pass through a cooling zone.

EXAMPLE

In a pilot plant, a rotary kiln which was heated partly directly and partly indirectly was fed at a rate of 70 kg/h with aluminum fluoride trihydrate, which contained 6% free moisture. The rotary kiln was operated at 6.8 r.p.m. After a mean residence time of 29.6 minutes, calcined aluminum fluoride having an $AlF_3$ content above 97% and an ignition loss of 0.3 to 0.4% was discharged through the product discharge outlet of the kiln at a rate of 39.4 kg/h. The rotary kiln had an overall length of 5 meters and was directly heated over 3.8 meters and indirectly heated over 1.2 meters of its length. The steel tube shell was 650 mm in diameter and had a high-alumina tamped lining. The free inside diameter was 430 mm. At the product discharge end, a cylindrical inner tube consisting of steel was installed, which was provided with eight lifting blades, which carried a central tube consisting of heat-resisting high-grade steel. The outside diameter of the central tube for the indirect heating of the material to be treated amounted to 300 mm.

The hot gas required for the heat treatment of the material to be treated was generated by a consumption of 5.5 kg fuel oil per hour. The hot gases had a temperature of about 1200° C. In a commercial plant, about 10% of the fuel might be saved under these circumstances by a recycling of flue gas to adjust the hot gas temperature. The gas temperature amounted to 890° C. at the transition from the indirectly heated to the directly heated zone and to 250° at the gas exit from the kiln at the feed end thereof. Entrained dust particles were collected from the gas stream in a succeeding cyclone and were recycled and fed to the kiln together with the material to be treated. A fan served to produce the required sub-atmospheric pressure in the system and to discharge the exhaust gas into the atmosphere.

The advantages afforded by the invention reside in that hot spots in the material to be treated are avoided in the calcining zone with simple means, the shell of the rotary kiln may be made of normal-grade steel, the inserted body may be thin-walled for higher heat transfer because it is hardly subjected to static stress, the heat transfer can be substantially optimized and the inserted body can easily be replaced.

In accordance with this invention, the central tube 3 can be secured to the shell of the rotary kiln so as to be rotatable therewith, i.e. the central tube itself rotates as the entire rotary kiln rotates in its stationary housing. Alternatively the central tube can be so equipped to itself rotate apart from rotation of the rotary kiln itself. This rotation can be at a faster or slower rate than the rotary kiln itself and the central tube can rotate in the same direction as the rotary kiln or in the opposite direction. The central tube 3 can also be secured in a non-rotatable manner so that it does not rotate and the rotary kiln walls rotate about a stationarily disposed central tube. In all events, the bulk material is heated by indirect heat exchange by hot gases disposed within said central tube, the bulk material being disposed in the annular zone defined by the outer walls of the central tube and the inner walls or shell of the rotary kiln.

As shown in the embodiment of the drawings, hot gases are ignited within the central tube. It is also contemplated that the hot gases be ignited at some other point other than within the rotary kiln itself and the hot gases are thereafter fed into the rotary kiln where they heat, by indirect heat exchange, the bulk material disposed in the annular zone between the outer walls of the central tube and the inner walls of the rotary kiln. In such event, if desired, a portion of the hot gases can be fed at the bulk material feed end of the rotary kiln so as to effect a predrying or precalcining of the bulk material.

In the embodiment shown in the drawings, the bulk material is predried or precalcined in the zone disposed upstream of the central tube. If desired, this zone itself can serve as a drying or calcining zone and predrying and/or precalcining can be effected in a zone disposed upstream thereof.

What is claimed is:

1. In a process for drying and/or calcining bulk material in a rotary kiln comprising means for feeding bulk material into said kiln at one end, means at the other end for withdrawing bulk material, means for passing hot gases in counter-current flow to said bulk material and contacting said bulk material with said hot gases, a centrally disposed tube being disposed axially within said rotary kiln toward the bulk material discharge end of said rotary kiln, whereby an annular space is defined between the outer wall of said central tube and inner wall of said rotary kiln, means for passing hot gases within said central tube and means for passing said bulk material through said annular space whereby said bulk material is heated by indirect heat exchange with hot gases within said tube, the improvement which comprises trickling said bulk material over the outside of both sides of said central tube in substantially equal amounts, said central tube being secured to the shell of said rotary kiln by means of lifting blades, each lifting blade being connected at its trailing end with the shell of the rotary kiln such that it does not permit bulk material to pass therethrough, each lifting blade being connected to said central tube by connecting members which cause material falling out of the lifting blades to trickle down the outside surface of said tube and the lifting blades have a shape that the material falling from the leading edges trickles down on both sides of said tube in substantially equal amounts.

2. A process according to claim 1, wherein hot gases are ignited within said tube.

3. A process according to claim 1, wherein a partial stream of exhaust gas from the rotary kiln is recycled into said tube.

4. A process according to claim 1, wherein the quantity that is transferred by indirect heat exchange per unit of bulk material to be treated is controlled by controlling the amount of material heated by indirect heat exchange.

5. A process according to claim 1, wherein the quantity of heat which is transferred by indirect heat exchange per unit of bulk material to be treated is controlled by controlling the amount of bulk material passed through the annulus defined by the interior walls of the rotary kiln and the exterior walls of the central tube.

6. In a rotary kiln for drying and/or calcining bulk material comprising means for feeding bulk material into said kiln at one end, means at the other end for withdrawing bulk material, means for passing hot gases in counter-current flow to said bulk material and contacting said bulk material with said hot gases, the improvement wherein said rotary kiln comprises a centrally disposed tube disposed axially within said rotary kiln toward the bulk material discharge end of said rotary kiln, whereby an annular space is defined between the outer wall of said central tube and inner wall of said rotary kiln, means for passing hot gases within said central tube and means for passing bulk material on the outer wall of said central tube, whereby bulk material can be heated by indirect heat exchange with hot gases within said tube, said central tube being secured to the shell of said rotary kiln by means of lifting blades, each lifting blade consisting of a bottom-plate being arranged tangentially to and with a certain distance from the outside surface of the central tube and a rear-plate being connected to the bottom-plate at an obtuse angle, each lifting blade being connected at its trailing end of the rear-plate with the shell of the rotary kiln such that it does not permit bulk material to pass therethrough, each lifting blade being connected to said central tube by connecting members between bottom-plate and central tube which cause material falling out of the lifting blades to trickle down the outside surface of the central tube and the lifting blades are so shaped that material falling from the leading edges of the bottom-plates trickles down on both sides of said central tube in substantially equal amounts.

* * * * *

UNITED STATES PATENT AND TRADEMARK OFFICE

CERTIFICATE OF CORRECTION

PATENT NO. : 4,354,826

DATED : Oct. 19, 1982

INVENTOR(S) : Gerhard Krüger et al

It is certified that error appears in the above—identified patent and that said Letters Patent is hereby corrected as shown below:

Title Page Assignee: Insert --Voest-Alpine Aktiengesellschaft, Werksgelände, Austria-- after "Germany".

Signed and Sealed this

*Tenth* Day of *May 1983*

[SEAL]

*Attest:*

GERALD J. MOSSINGHOFF

*Attesting Officer*

*Commissioner of Patents and Trademarks*